United States Patent [19]

Harting et al.

[11] Patent Number: 5,022,866

[45] Date of Patent: Jun. 11, 1991

[54] ELECTRICAL PLUG AND SOCKET CONNECTOR WITH U-SHAPED LOCKING HOOP

[75] Inventors: Dietmar Harting, Espelkamp; Günter Piewitt, Lübbecke, both of Fed. Rep. of Germany

[73] Assignee: Harting Elektronik GmbH, Espelkamp, Fed. Rep. of Germany

[21] Appl. No.: 594,260

[22] Filed: Oct. 9, 1990

[30] Foreign Application Priority Data

Nov. 7, 1989 [DE] Fed. Rep. of Germany ..... 3937022

[51] Int. Cl.[5] ..... H01R 13/62; H01R 13/64

[52] U.S. Cl. ..... 439/372; 439/370

[58] Field of Search ..... 439/296, 299, 345, 347, 439/348, 350–352, 367–372, 527, 529, 532, 533, 534, 152, 153, 157

[56] References Cited

U.S. PATENT DOCUMENTS 2,487,801 11/1949 Healy, Jr. ..... 439/369

4,699,594 10/1987 Assel et al. ..... 439/152

FOREIGN PATENT DOCUMENTS 2240450 10/1973 Fed. Rep. of Germany ..... 439/372

2632338 1/1978 Fed. Rep. of Germany ..... 439/345

2914929 10/1980 Fed. Rep. of Germany ..... 439/370

1332197 6/1963 France ..... 439/345

0658628 10/1951 United Kingdom ..... 439/372

*Primary Examiner*—David L. Pirlot

*Assistant Examiner*—Julie R. Daulton

*Attorney, Agent, or Firm*—Jordan and Hamburg

[57] ABSTRACT

An electrical plug and socket connector with a U-shaped locking hoop has cylindrical rollers provided at the side parts and the overlapping parts of the locking hoop. The rollers are provided with a central slot and an axle and are snapped into the side parts. The attachment of the locking hoop to one plug and socket connector half is such that the locking hoop can be snapped onto the bearing pins of the plug and socket connector half.

17 Claims, 2 Drawing Sheets

ELECTRICAL PLUG AND SOCKET CONNECTOR WITH U-SHAPED LOCKING HOOP

The invention relates to an electrical plug and socket connector with one or two U-shaped, bent, locking hoop(s) of sheet metal, which can be swivelled about bearing pins of the one half of the plug and socket connector. When the plug and socket connector is locked, rollers, which are disposed at the side parts of the locking hoop, overlap the locking lugs disposed on the other half of the plug and socket connector. An elastic packing is disposed between the halves of the plug and socket connector. With such plug and socket connectors, which are constructed particularly as multipin plug and socket connectors and are provided with relatively bulky and heavy pressure diecast housings and find application in industrial switchgear and machine controls, it is necessary that the two halves of the plug and socket connector are pressed together firmly by the locking hoops, so that the tensile forces, which arise at the connecting cables, cannot separate the plug and socket connector and so that the coupled plug and socket connector is protected against entry of dirt and moisture. Moreover, it shall be possible to open and close the locking system with the least expenditure of force.

The German Utility Patent No. 18 37 972 and the German Offenlegungsschrift No. 22 40 450 discloses a U-shaped locking hoop for an electrical plug and socket connector. The side parts of said locking hoop are provided, on the one hand, with a borehole/bearing for the pivotable mounting at the lug of the one half of the housing of a plug and socket connector and, on the other, with a roller mounted by means of a rivet pin in the upper region of the side part. When the locking hoop is closed, the rollers overlap the lug disposed on the other part of the housing and hold the plug and socket connector firmly together. Moreover, on both side parts of the locking hoop, a spring is provided, which brings about a flexible holding together of the plug and socket connector. To seal the coupled plug and socket connector, an elastic packing is provided between the housing of the halves of the plug and socket connector.

Such locking hoops are functionally reasonably satisfactory. However, on the one hand, because of the plurality of the different individual parts, which must be manufactured or kept in stock, and, on the other, in view of the type of assembly and the time required for it, these locking hoops cause considerable costs because, aside from the wire springs and their attachment lugs in the side part of the hoop, two rollers with appropriate bolt rivets and at least two of the four lugs (bearing pins) with an enlarged outer flange are required to form the overlapping parts of the locking hoop, in order to prevent slippage or evasion of the hoop and springs. In addition, the locking hoops must be installed firmly in place by the manufacturer on the one or the other half of the plug and socket connector; the user does not have the possibility of installing such a locking hoop at the place of its use simply to the one or the other of the halves of the plug and socket connector that are to be coupled to one another, depending on the practicality and the requirements.

It is therefore an object of the invention to provide a plug and socket connector or its locking hoop similar to that mentioned at the beginning, so that the number of parts required is reduced significantly and the costs of manufacturing and warehousing consequently are reduced appreciably.

Pursuant to the invention, this objective is accomplished owing to the fact that the rollers are constructed essentially cylindrically and are provided with a slot, which subdivides the respective roller into two partial rollers, an axle, which connects these two partial rollers, being formed between them, that the width of the slot is slightly wider than the thickness of the material of a side part of the locking hoop, that the side parts of the locking hoop are provided in their upper end regions with a bearing borehole corresponding to the axle diameter of the roller, that a conically shaped slot extends from the edge of the side part to the respective bearing borehole, said slot having its greatest width at the edge of the side part and having at the transition into the bearing borehole a width, which is somewhat less than the diameter of the axle or of the bearing borehole, and that the roller can be locked into the bearing borehole in such a manner, that its partial rollers are in each case on either side of the respective side part of the locking hoop.

The advantages achieved with the invention consist particularly therein that, to produce a locking hoop, it is necessary to manufacture, and keep in stock only two different parts, namely a U-shaped, stamped out, bent component and the rollers, which are constructed as a turned part. The rollers can be latched manually or optionally also by machine in an appropriately automated manufacturing process into the retainers in the hoop side part.

Due to the rollers, an almost wear-free locking and unlocking of the hoops and the plug and socket connector halves is possible. This is important particularly when the connector is operated frequently. The forces required to operate the connector are extremely small. Due to the packing, which is formed appropriately elastically between the two halves of the plug and socket connector, a sufficient flexibility and an adequate seal is achieved between the coupled halves of the plug and socket connector. It has been observed that an additional spring, which otherwise is generally customary, becomes unnecessary.

Due to the symmetrical construction and the central holding of the rollers at the side parts, it is, moreover, ensured that these rollers, during the locking or unlocking process, that is, while sliding onto the respective housing lug, do not exert any transverse forces on the side parts of the hoop. By these means, it is avoided that the side parts evade sideways during the locking procedure.

In locking hoops, the bearings of which are constructed for the pivotable attachment to the respective halves of the plug and socket connector as simple sheet metal pull-throughs or boreholes with conical inlet slits, a further advantage arises out of the fact that this hoop can be snapped or locked onto the bearing pin of the respective half of the plug and socket connector. This assembly procedure can also be carried out by the user on location, in which case the user can decide to which of the two halves of the plug and socket connector the locking hoop is to be attached—or also still change this assignment subsequently.

An example of the operation of the invention is shown in the drawing and described in greater detail in the following.

DESCRIPTION OF THE PREFERRED EMBODIMENTS

Figure 1:
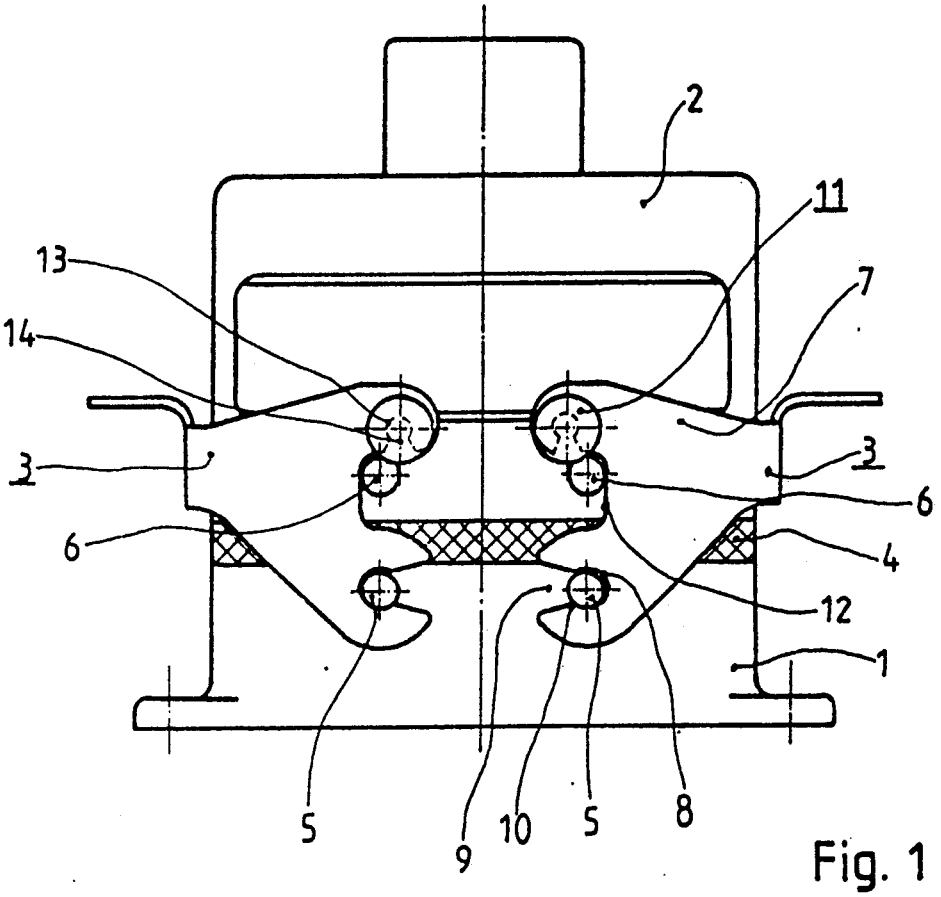
FIG. 1 shows a perspective view of a plug and socket connector with locking hoops.
Figure 2:
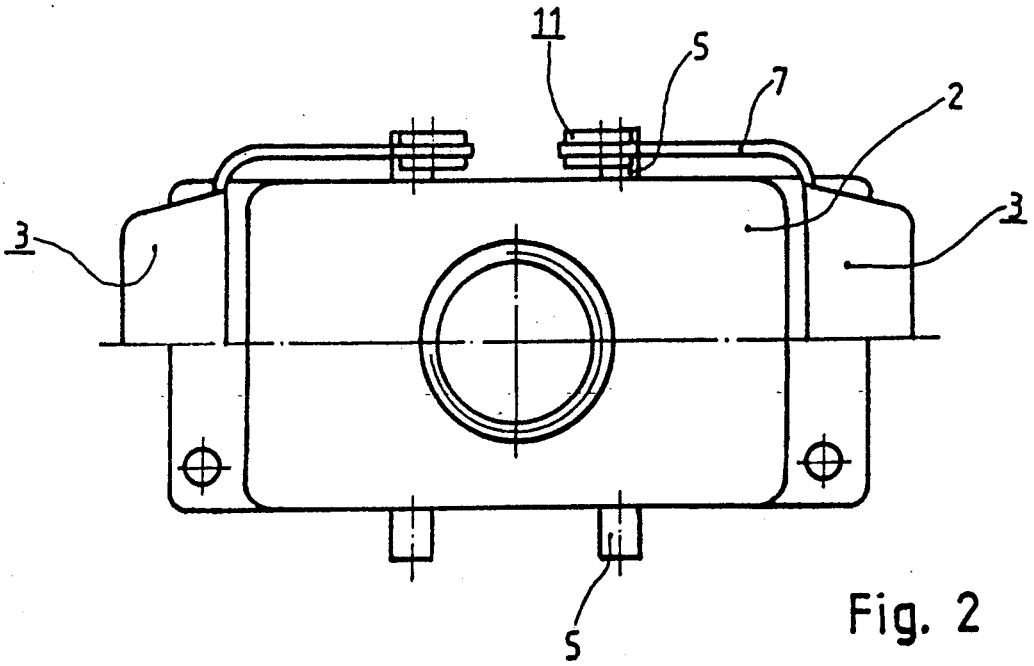
FIG. 2 is a plan view of the plug and socket connector of FIG. 1.

In FIG. 1, a plug and socket connector is shown in the coupled state, while FIG. 2 shows a plan view of this connector. In order to be able to identify the individual parts better, the locking hoops are shown as a cutaway drawing. The plug and socket connector consists essentially of the two halves 1 and 2 of the plug and socket connector, as well as of the two U-shaped locking hoops 3. In the interior of the plug and socket connector halves, that is of their housings, the latter usually being produced as pressure diecast housings, multipin contact inserts, which are not shown in greater detail here, are disposed. When the halves of the plug and socket connector are assembled, the contact elements of the contact inserts make mutual contact and establish the electrical connection of the electrical leads of the two halves of the plug and socket connector. An elastic packing 4 is provided between the two halves of the plug and socket connector.

At the sides of the plug and socket connector halves 1, 2, bearing pins 5 and locking lugs 6 are disposed, which preferably all have the same diameter. The pins or lugs are constructed as rivet pins and riveted into the side surfaces of the housing of the plug and socket connector halves or are also integrally molded in one piece with the respective housing while the latter is being produced as an injection molded part.

The locking hoops are produced by a known method from sheet metal material in a stamping and bending operation. At the same time, they are bent essentially into the shape of a U. For the rotatable or pivotable attachment/mounting of the locking hoops to one half of a plug and socket connector, the side parts 7 of the locking hoops are provided in their lower region with a borehole/bearing borehole 8, the diameter of which is somewhat larger than the diameter of the bearing pin 5.

From the outer edge of the side parts, a conically shaped slot 9 is provided, which goes over into the borehole 8. This slot has its greatest width at the edge of the side part and the width at the transition 10 into the bearing borehole 8 is somewhat less than the diameter of the respective bearing pin 5 or the bearing borehole itself. By these means, the locking hoop can be pushed from the narrow side of the plug and socket connector half onto the bearing pin 5 and snapped onto this with a slight pressure, as shown in FIG. 1. The locking hoops 3 are thus held pivotably at the plug and socket connector half 1 and, at the same time, in such a manner that they cannot be lost. As already mentioned above, the locking lugs 6 of the upper half 2 of the plug and socket connector have the same diameter as the bearing pins 5 of the lower half of the plug and socket connector. The locking hoops could thus be snapped in the same manner on the lugs of the upper half 1 of the plug and socket connector; in that eventuality and in accordance with the above definition, the bearing pins would 5 would become the locking lugs and the reverse. At which of the two halves of the plug and socket connector the locking hoops are rotatably attached can be determined by the user depending on the requirements (handling). As is readily seen, this assignment can also be changed subsequently. In the upper region of the side parts 7, a cylindrical roller 11 is provided. During the locking process, said roller 11 slides over the locking lug 6 of the plug and socket connector half 2 until the lugs come to lie against the edge 12 of the side part and the roller has rolled over the highest point of the respective locking lug. Due to its elasticity, the packing 4, which is disposed between the halves 1, 2 of the plug and socket connector, initially is highly compressed during the locking process. However, at the end of the locking process, namely when the roller has passed over the highest point of the locking lug, the pressure on the packing is released again somewhat. However, through the appropriate elasticity of the packing and the dimensional coordination of the distances between the bearing pins and the locking lugs in conjunction with the external diameter of the rollers, care has been taken to ensure that sufficient pressure, which ensures that the interior of the plug and socket connector is sealed satisfactorily, is exerted on the packing even after the pressure has been released somewhat.

It has turned out that consequently it is possible to do without the spring, which is otherwise generally used to achieve the locking pressure in such locking devices.

To attach the rollers 11, a bearing borehole 13 is provided in the upper region of the side parts 7 and a conical slot 14 extends from the edge of the side parts towards this borehole and finally goes over into this borehole. The slot has its greatest width at the edge of the side part and its width at the transition into the borehole 13 is somewhat smaller than diameter of the borehole 13.

Figures 3A, 3B:
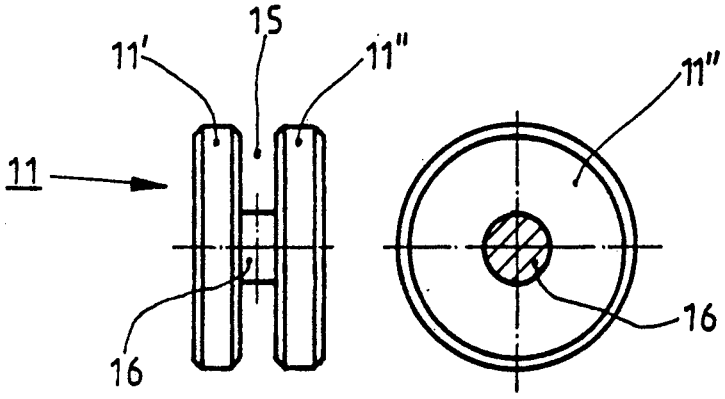
FIG. 3A shows a perspective view of a roller of the locking hoop on a larger scale.
FIG. 3B shows a perspective view of a roller of FIG. 3A in section.

As shown in FIGS. 3A and 3B, the rollers 11 are constructed as cylindrical rollers. They are preferably produced as simple turned parts and provided with a central slot 15, by means of which two partial rollers 11', 11" are formed, which are connected to one another by means of an axle 16. The width of this slot is slightly larger than the thickness of the material of the side parts 7. The diameter of the axle is somewhat smaller than the diameter of the bearing boreholes 13 in the side parts, but is somewhat larger than the width of the transition 17 of the conical slot 14 into the respective bearing borehole.

To assemble them on the side parts 7, the rollers are pushed onto the side parts 7 in such a manner, that the two partial rollers 11', 11" are on either side of the respective side part, that is, the axle 16 of the roller is pushed through the slot 14 and pushed through the constriction 17 of the slot into the respective bearing borehole 13. The rollers can therefore easily be rotated, but are held in the side part of the locking hoop and cannot be lost. The direction/opening of the slot is, of course, selected so that the rollers are pushed into the bearing borehole during the locking process and cannot slip out.

Due to the symmetrical construction of the rollers, the partial rollers 11', 11" being on either side of the side part, it is achieved that, during the locking procedure or with the plug and socket connector in the locked state, no transverse forces whatsoever are exerted on the rollers or the hoop side parts, so that it is completely impossible for the rollers to slide down from the locking lug.

Figure 4:
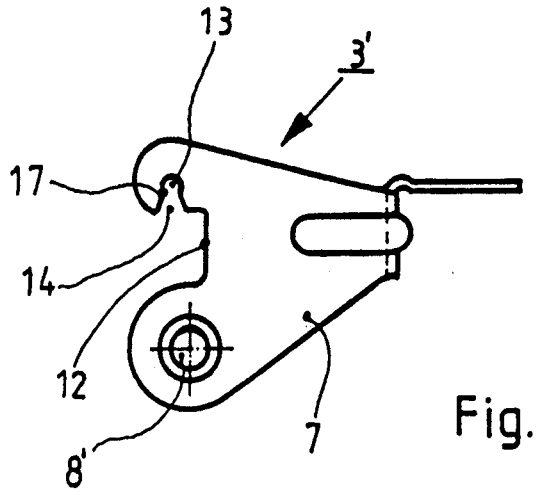
FIG. 4 shows a side view of a locking hoop.
Figure 5:
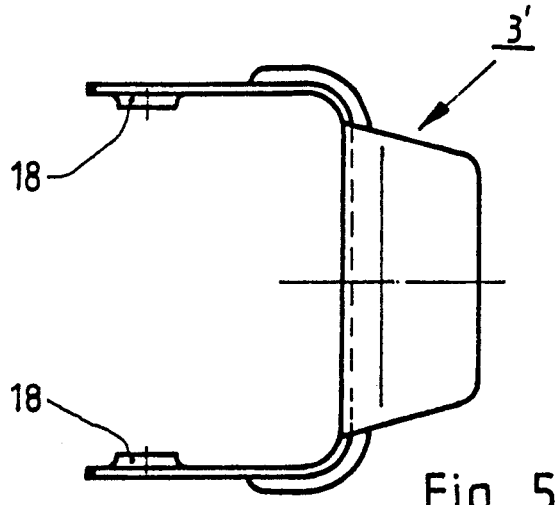
FIG. 5 shows a plan view of the locking hoop of FIG. 4.

In FIGS. 4 and 5, a modified locking hoop 3' is shown, which differs from the above-described locking hoop owing to the fact that the region of the side parts 7 having the bearing borehole is modified. Provisions are made here so that the bearing boreholes 8' are constructed as openings closed all around, that is, as sheet metal pull-throughs. A "guide sleeve" with an enlarged bearing surface—in relation to the material thickness of the side part—is achieved by the sheet metal pull-through 18.

Such a locking hoop is mounted on the plug and socket connector half by bending open the side parts, which have some springiness, and snapping them onto the bearing pins of the plug and socket connector half so that the lugs slide into the bearing boreholes 8'. Such a locking hoop 3' preferably is used for plug and socket connectors, which must be operated extremely frequently and for which then—particularly when a relatively thin material is used for the side parts—there is the danger with a locking hoop 3 that the bearings in the side parts will wear prematurely or the side parts will wear out the bearing pins.

What is claimed is:

1. An electrical connecting device comprising a plug connector and a socket connector, each of said connectors having a pin, a locking member pivotably mounted on a first pin of one of said connectors, said locking member having a mounting portion, a roller means rotatably mounted on said mounting portion of said locking member, said roller means comprising an axle and two axially spaced roller parts on said axle to define a space between said two roller parts, said space having an axial width slightly greater than the width of said mounting portion of said locking member, said mounting portion of said locking member having an outer edge, a support opening in said mounting portion of said locking member and a slot leading from said support opening to said outer edge, said support opening having a diameter substantially equal to the diameter of said axle, said slot being tapered with a narrowest slot width being juxtaposed to said support opening, said narrowest width of said slot being less than the diameter of said axle such that said roller means is assembled on said mounting part of said locking member by sliding said axle through said slot to said support opening while temporarily widening said narrowest width of said slot, said mounting portion of said locking member being disposed in said space between said two roller parts, said locking member being pivotal to a locking position in which said roller means lockingly engages a second pin on the other of said connectors.

2. An electrical connector according to claim 1, wherein each of said connectors comprises a housing, said pins being of the same material as the respective housing and being formed integral with the respective housing.

3. An electrical connector according to claim 1, wherein said tapered slot has a widest slot width juxtaposed to said outer edge and said narrowest slot width juxtaposed to said support opening.

4. An electrical connector according to claim 1, wherein said roller parts have a cylindrical configuration.

5. An electrical connector according to claim 1, wherein said locking member is made of sheet metal.

6. An electrical connector according to claim 1, wherein said locking member has a support portion and pivot means pivotably supporting said locking member on said support portion, said support portion being spaced from said mounting portion.

7. An electrical connector according to claim 6, wherein said locking member has a generally U-shaped configuration having first and second legs, said first leg having a first mounting portion with a first mounting means and a first support portion with a first pivot means, said second leg having a second mounting portion with a second mounting means and a second support portion with a second pivot means, each of said connectors having a pair of said pins.

8. An electrical connector according to claim 1, wherein said first and second pins have substantially the same diameter.

9. An electrical connector according to claim 8, wherein said first and second pins are disposed on said connectors such that said locking member is interchangeably pivotably supported on either pin to lockingly engage the other pin.

10. An electrical connector according to claim 6, wherein said support portion of said locking member has a second outer edge, a second support opening in said support portion and a second slot leading from said second support opening to said second outer edge, said second support opening having a diameter substantially equal to the diameter of said first pin, said second slot being tapered with a narrowest slot width being less than the diameter of said first pin such that said locking member is mounted on said first pin by sliding said first pin through said second slot to said second support opening while temporarily widening said narrowest width of said second slot.

11. An electrical connector according to claim 10, wherein said second tapered slot has a widest slot width juxtaposed to said second outer edge and said narrowest slot width juxtaposed to said second support opening.

12. An electrical connector according to claim 6, wherein said pivot means comprises a cylindrical section on said support portion, said cylindrical section being rotatably supported on said first pin.

13. An electrical connector according to claim 12, wherein said support portion is made of sheet metal having a sheet metal thickness, said cylindrical section having an axial length greater than said sheet metal thickness.

14. An electrical connector according to claim 6, wherein each of said connectors has a central axis, said central axes being disposed along an interconnecting line when said connectors are connected to one another, said axle having an axle axis, said locking member having a pre-nonlocking position in which said locking member is pivotably supported by said pivot means and said roller means is in contact with said second pin, said axle axis being on one side of said interconnecting line when said locking member is in said pre-nonlocking position, said axle axis being on the opposite side of interconnecting line when said locking member is in said locking position.

15. An electrical connector according to claim 14, wherein said roller means rolls on said second pin when said locking member moves between said pre-nonlocking position and said locking position.

16. An electrical connector according to claim 14, wherein said pivot means has a pivot axis, a distance between said pivot axis and the outer periphery of said roller means when said locking member is in said locking position is designated a first distance, a distance between said pivot axis and the outer periphery of said roller means when said locking member is in said pre-nonlocking position is designated a second distance, said locking member having an intermediate position between said locking position and said pre-non-locking position, a distance between said pivot axis and the outer periphery of said roller means when said locking member is in said intermediate position is designated a third distance, said first and second distance being substantially equal, said third distance being less than said first and second distances.

17. An electrical connector according to claim 16, wherein said axle axis is disposed on said interconnecting line when said locking member is in said intermediate position.

* * * * *